US006237839B1

(12) United States Patent
Brown

(10) Patent No.: US 6,237,839 B1
(45) Date of Patent: May 29, 2001

(54) PAPERBOARD BEVERAGE CARRIER

(75) Inventor: William L. Brown, Mason, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/688,505

(22) Filed: Oct. 16, 2000

(51) Int. Cl.[7] ..... B65D 5/468

(52) U.S. Cl. ..... 229/117.13; 229/117.12; 229/920

(58) Field of Search ..... 229/117.12, 117.13, 229/117.14, 920; 206/140, 141, 427, 434

(56) References Cited

U.S. PATENT DOCUMENTS

| | | | | |
|---|---|---|---|---|
| 2,598,051 | * | 5/1952 | Guyer et al. | 229/117.13 |
| 4,463,852 | * | 8/1984 | Stone | 206/141 |
| 4,684,059 | * | 8/1987 | Rusnock | 206/427 |
| 4,966,324 | * | 10/1990 | Steel | 206/140 |
| 4,989,778 | * | 2/1991 | Saulas | 229/117.13 |
| 5,480,091 | * | 1/1996 | Strout | 229/920 |
| 5,906,313 | * | 5/1999 | Oliff | 229/117.13 |
| 6,126,066 | * | 10/2000 | Peterson et al. | 229/117.13 |

FOREIGN PATENT DOCUMENTS

| | | | | |
|---|---|---|---|---|
| 1602857 | * | 11/1981 | (GB) | 229/117.12 |

* cited by examiner

*Primary Examiner*—Gary E. Elkins
(74) *Attorney, Agent, or Firm*—Ostrager Chong & Flaherty

(57) ABSTRACT

An improved paperboard beverage carrier is disclosed having an improved lift handle. The improved lift handle comprises a laterally extending elongated handle opening within the top panel of the carrier. At least one continuous score line encircles the handle opening and extends onto the carrier side panels to limit the propagation of paperboard tears emanating from the handle opening. Predetermined perforated tear lines are further provided extending from the lateral ends of the handle opening and terminating at the encircling score line.

10 Claims, 3 Drawing Sheets

PAPERBOARD BEVERAGE CARRIER

TECHNICAL FIELD OF THE INVENTION

The present invention relates to paperboard cartons such as carriers for beverage cans or bottles and, more particularly, to sleeve-type carriers having a carrying handle comprising a single elongate opening extending laterally across the top panel or wall of the carrier.

BACKGROUND OF THE INVENTION

Paperboard is used for packaging a wide variety of consumer products such as beverage carriers. Paperboard carriers having integral carrying handles are well known for use on bottle and/or can carriers. A typical handle comprises a single elongate opening extending transverse or laterally across a portion of the top panel, or wall, of the carrier. The handle opening may include flaps which deflect inwardly when the user inserts their fingers into the handle opening. Examples of typical beverage carrying handles for sleeve-type, beverage carriers can be found in U.S. Pat. Nos. 4,558,816 and 4,785,991.

When lifting a paperboard beverage carrier having an integral handle and containing beverage cans or bottles, the paperboard fibers are typically stressed, resulting in potential tearing of the paperboard and failure of the carrier.

SUMMARY OF THE INVENTION

It is an object of the invention to provide an improved construction for a paperboard, sleeve type, beverage, carrier, having an integral handle.

Another object of the invention is to provide an improved construction for a, sleeve type, paperboard, beverage, carrier having tear-stop score lines encircling the carrier handle.

According to the present invention, a sleeve-type, beverage, carrier comprises a top panel, two side panels, a pair of end panels and a bottom panel made from a unitary paperboard blank. A carrying handle is provided comprising an oval shaped opening extending laterally across a portion of the top panel. A pair of concentric, oval shaped, score lines encircle the handle opening extending laterally across the top panel whereby the outer oval score line extends onto each side panel. The oval score lines are positioned adjacent the handle opening for preventing paperboard tears, originating at the handle opening, from propagating across the top panel of the carrier thereby compromising the structural integrity of the carrier.

Preferably, the major axis of the oval shaped handle opening extends 70 to 75% of the lateral width of the top panel, and the major axis of the inner oval score line extends 85 to 95% of the lateral width of the top panel. The minor axis of the inner oval score line is approximately 20 to 30% greater than the minor axis of the handle opening. The major axis of the outer oval score line is approximately 2 to 2.5 times greater than the major axis of the handle opening, while the minor axis of the outer oval score line is approximately 60 to 65% greater than the minor axis of the handle oval opening.

A pair of, spaced apart, diverging cut lines extend laterally from each opposing hand hold end, through the inner oval score line terminating at the outer oval score line.

Further objects, features and advantages of the invention will become apparent in light of the following description.

BRIEF DESCRIPTION OF THE DRAWINGS

Reference will be made in detail to a preferred embodiment of, the present invention, which is illustrated in the accompanying drawings. The drawings are intended to be illustrative and not limiting. Although the invention will be described in the context of the preferred embodiment, it should be understood that it is not intended to limit the spirit and scope of the invention to this specific embodiment.

The structure, operation, and advantages of the present preferred embodiment, of the invention, will become further apparent upon consideration of the following description taken in conjunction with the accompanying drawings, wherein.

DETAILED DESCRIPTION OF THE INVENTION

General Construction Of Carrier

Figure 1:
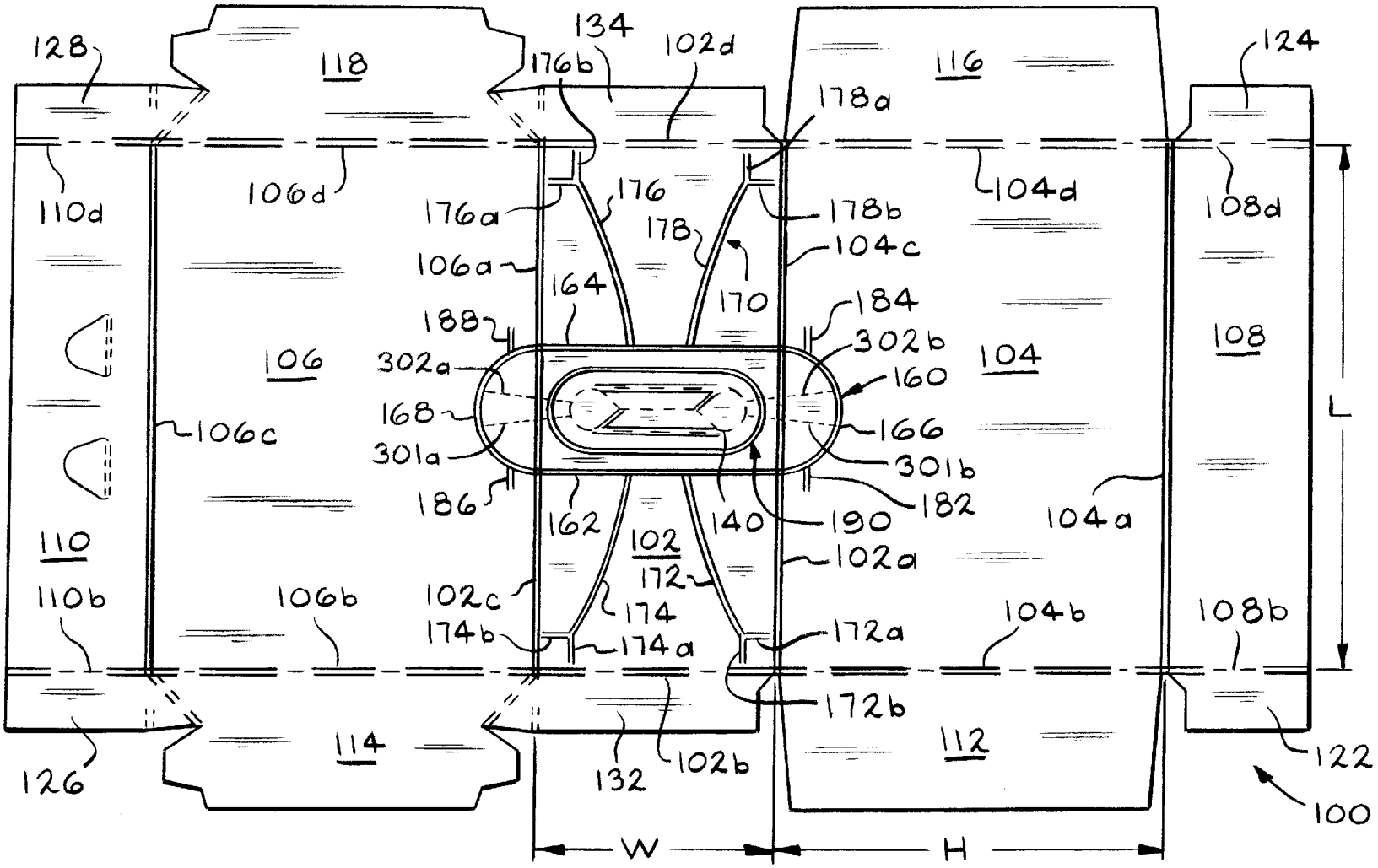
FIG. 1 is a plan view of a unitary paperboard blank for making the beverage carrier of the present invention.
Figure 2:
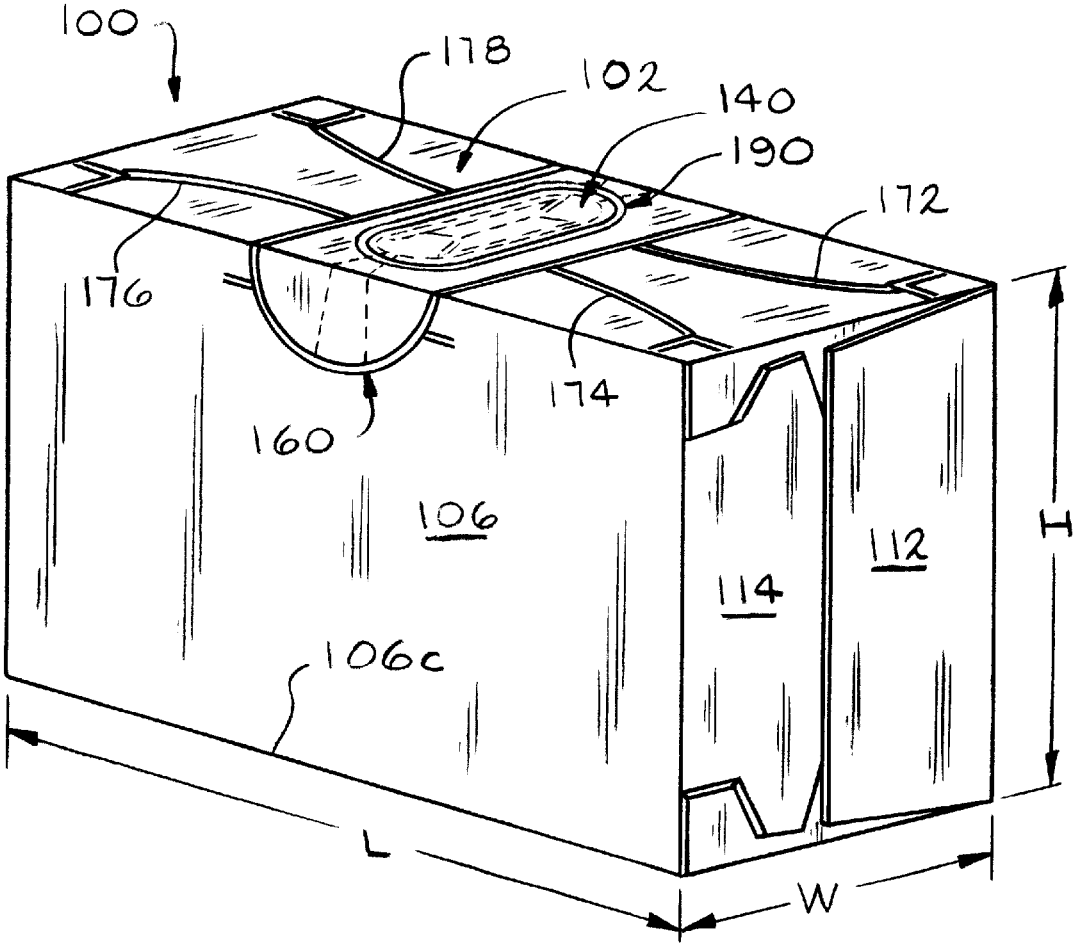
FIG. 2 is an assembled perspective view of the beverage carrier made in accord with the present invention.

FIG. 1 illustrates a unitary paperboard blank 100 for a beverage carrier according to the present invention in an unassembled condition. FIG. 2 illustrates the assembled beverage carrier 100 having a multiplicity of beverage containing cans or bottles therein. A beverage carrier of this type is typically referred to as a "sleeve-type" or "tube-style" carrier.

The paperboard blank of the panels of the beverage carrier 100 shown in FIG. 2 typically comprises a number of interconnected panels and flaps defined and foldably connected to one another by associated score lines, described in greater detail hereinbelow. All panels and flaps are visible in FIG. 1.

As used herein, a "score line" is defined as a rupturing of the surface of the paperboard material, typically resulting in a depression on one side of the material and a corresponding welt on the other side which permits the paperboard material to deform, as may be desired, along the line.

As used herein, a "cut line" is defined as a cut which extends completely through the paperboard material.

As used herein a "perforated line" is defined as a series of short, separated, cut lines, typically along a straight or curved line, extending completely through the paperboard material, to facilitate intentional tearing along the line.

Top panel 102 is generally rectangular having four edges, each edge defined by an associated score line 102*a*, 102*b*, 102*c*, 102*d*. Top panel 102 has a longitudinal length "L" and a lateral width "W".

A first side panel 104 is generally rectangular having four edges, each edge defined by an associated score line 104*a*, 104*b*, 104*c*, 104*d*. Side panel 104 is foldably connected to top panel 102 by score line 104*c* which is coincident with the score line 102*a*.

A second side panel 106 is similarly rectangular having four sides, each side defined by an associated score line 106*a*, 106*b*, 106*c*, 106*d*. Side panel 106 is foldably connected to top panel 102 by score line 106*a* which is coincident with score line 102*c*. Both side panels 104 and 106 have a longitudinal length "L" and height "H".

A first partial bottom panel 108 is foldably connected to side panel 104 by score line 104*a*, and a comparable second partial bottom panel 110 is foldably connected to side panel 106 by score line 106*c*. Both partial bottom panels, 108 and 110, are dimensioned so that portions of them overlap when carrier 100 is assembled, the overlapping portions being glued together to form an overall bottom panel of length "L" and width "W".

End flap 112 is foldably connected to side panel 104 by score line 104*b*, and an associated end flap 114 is foldably connected to side panel 106 by score line 106*b*. Both end flaps 112 and 114 are dimensioned so that portions of them overlap when beverage carrier 100 is assembled, the overlapping portions being glued together to form an overall composite first end panel of width "W" and height "H" for the assembled beverage carrier 100.

End flap 116 is foldably connected to side panel 104 by score line 104*d*, and an associated end flap 118 is foldably connected to side panel 106 by score line 106*d*. Both end flaps 116 and 118 are dimensioned so that portions of them overlap when beverage carrier 100 is assembled, the overlapping portions being glued together to form an overall composite end panel of width "W" and height "H" for the assembled beverage carrier 100.

Flaps 122 and 124 are foldably connected to opposite ends of partial bottom panel 108 by score lines 108*b* and 108*d*, respectively. Similarly flaps 126 and 128 are foldably connected to opposite ends of partial bottom panel 110 by score lines 110*b* and 110*d*, respectively. Flaps 132 and 134 are foldably connected to opposite ends of top panel 102 by score lines 102*b* and 102*d*, respectively. Flaps 122, 124, 126, 128, 132, 134 are adapted to be folded downwardly, with respect to FIG. 1, prior to flaps 112, 114, 116 and 118 being folded whereby they provide longitudinal support against which flaps 112, 114, 116 and 118 are glued.

Carrier 100 is suitably formed of a paperboard material having a thickness of approximately 0.38–0.64 mm. When assembled, carrier 100 has a length "L" of approximately 265 mm, a width "W" of approximately 122 mm, and a height "H" of approximately 197 mm, and provides a strong construction suitable for carrying the weight of twelve full 12 fluid ounce beverage cans therein. It should be understood that any dimensions set forth herein are merely exemplary, and should not be interpreted as limiting the present invention.

The general construction of carrier 100, described hereinabove, is generally well known in the industry and many variations in the size or shape of the various panels and flaps can be made merely by changing the design of the cutting and scoring dies of standard blank forming or packaging machinery.

Carrying Handle Construction

A generally oval shaped, carrying handle opening 140 is disposed laterally on top of panel 102, extending between score lines 102*a* and 102*c*, and located approximately midway along the longitudinal length L of top panel 102. Preferably, the grain of the paperboard is also aligned laterally across top panel 102.

Figure 3:
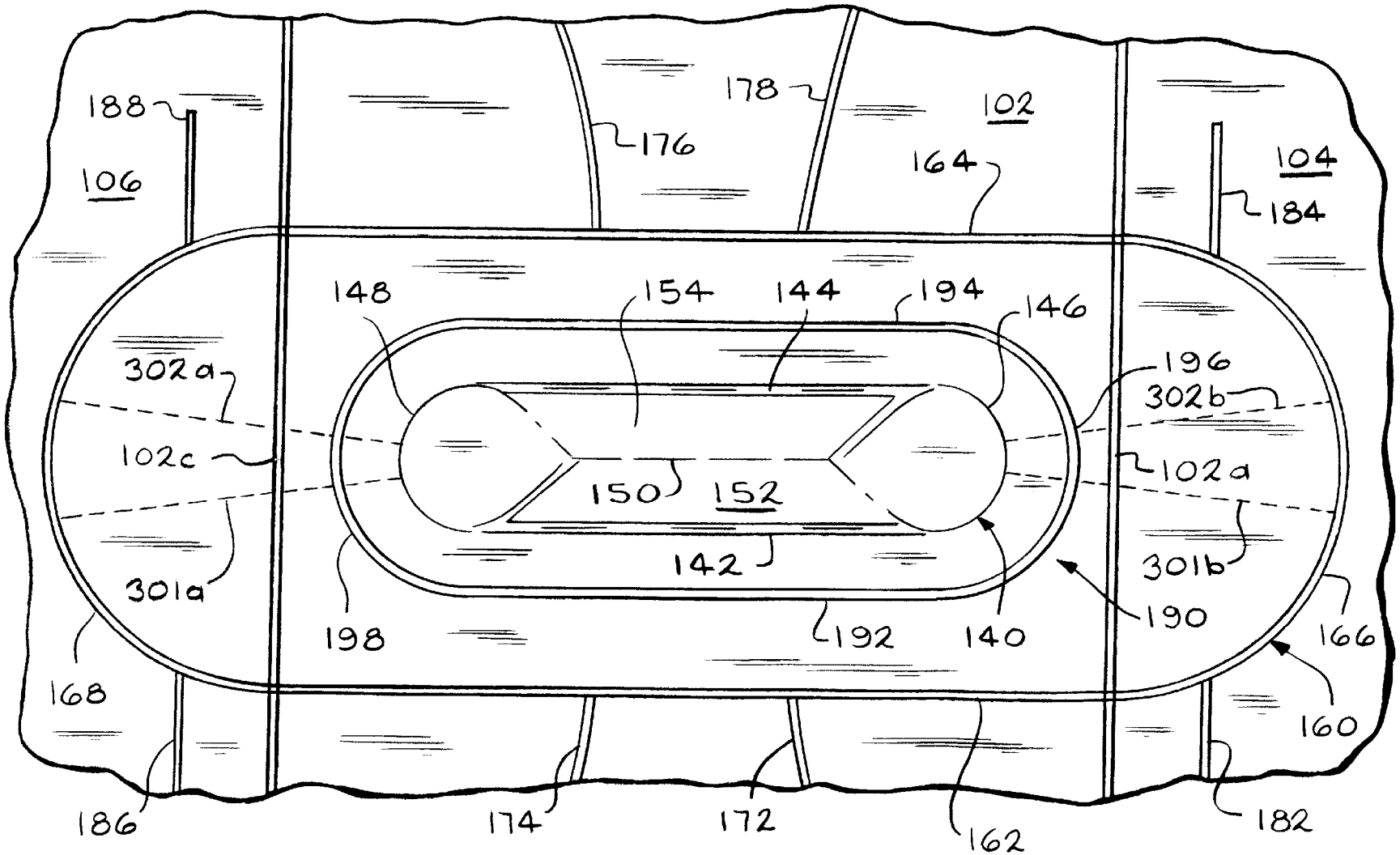
FIG. 3 is a detailed view of the handle portion of the paperboard blank of FIG. 1, according to the invention.

As best viewed in FIG. 3, handle opening 140 is oval shaped having two, generally parallel, opposite sides 142 and 144 and two opposite semi circular, ends 146 and 148. Handle opening 140 is suitably formed by score lines 142 and 144 and perforated lines 140, 146, 148, 198, and 150 thereby defining two tabs 152 and 154 which are displaced (separated from one another and folded inward) by a user urging their fingers against the tabs when lifting the beverage carrier. Such carrying handle construction is common within the industry.

Stress Relief Score Lines

When a user inserts their fingers into the handle opening 140 and lifts beverage carrier 100, top panel 102 tends to bow upward. In order to distribute the lifting forces, a number of stress-relieving score lines are provided in the top and side panels 102, 104 and 106.

Stress-relieving score line arrangement 160 comprises score line 162 extending laterally across top panel 102, from score line 102*a* to score line 102*c* between side 142 of handle opening 140 and the end (score line) 102*b* of top panel 102, thereby having a length equal to the width "W" of top panel 102. Similarly, score line 164 extends laterally across top panel 102, from score line 102*a* to score line 102*c*, between the side 144 of the handle opening 140 and the opposite end (score line) 102*d* of the top panel, thereby also having a length equal to the width "W" of top panel 102. Score line 164 is preferably parallel to score line 162. Score lines 162 and 164 are spaced a distance apart from one another which is approximately 20–25% of the length "L" of top panel 102. A semi-circular score line 166, disposed in side panel 104, connects the ends of score lines 162 and 164. A semi-circular score line 168, disposed in side panel 106, connects the opposite ends of the two score lines 162 and 164. Score lines 162, 164, 166 and 168 are preferably contiguous with one another.

It has been found preferable, during prototype testing, to provide a pair of separated, laterally diverging perforated tear lines 301*a*, 302*a*, and 301*b* and 302*b* (see FIG. 3) extending from each end (148 and 146 respectively) of hand hold opening 140, terminating at semi-circular score lines 168 and 166 respectively. The included angle between perorated lines 301 and 302 may lie between twenty (20) degrees and thirty (30) degrees and may vary depending upon the overall size of a particular beverage carrier.

The function of perforated lines 301 and 302 is to provide a predetermined tear along the lines thereby relieving stresses within the paperboard when the end user lifts the fully loaded carrier. As the user insert his/her fingers into handle opening 140 and lifts the carrier, a programmed tear is permitted to progress along either perforated lines 301*a* and 301*b*, or 302*a* and 302*b* depending upon which way the user chooses to lift the carrier thereby relieving stresses within the paperboard. The permitted programmed tear is stopped at semi-circular score lines 166 and 168.

In aggregate, score lines 162, 164, 166 and 168 form a generally-rectangular stress-relief score line arrangement 160 which extends laterally across top panel 102 and down onto side panels 104 and 106, and preferably centered around handle opening 140.

Thus, carrier 100 may be lifted by the fingers of one hand whereby top panel 102 will bow upwardly as the stress relief score line arrangement 160 distributes the lifting forces through top panel 102 and the upper portions of side panels 104 and 106.

As best viewed in FIG. 1, an additional arrangement 170 of stress relieving score lines is provided on top panel 102 comprising a pair of arcuately diverging score lines 172 and 174 extending from the central portion of score line 162, and extending outwardly to an associated corner of top panel 102. Each score line terminates with two diverging score lines 172*a*/172*b* and 174*a*/174*b*, respectively. More particularly, score line 172 divides into score line 172*a* intersecting score line 102*a* and score line 172*b* intersecting score line 102*b*. Score line 174 divides into score line 174*a* intersecting score line 102*b* and score line 174*b* intersecting score line 102*c*.

Similarly, a pair of arcuate score lines 176 and 178 extend from the central portion of the score line 164, diverging outwardly toward respective corners of top panel 102, whereat each score line divides into two score lines 176*a*/176*b* and 178*a*/178*b*, respectively. More particularly, score line 176 splits into a score line 176*a* intersecting score line 102*c* and score line 176*b* intersecting score line 102*d*. Score line 178 divides into score line 178*a* intersecting score line 102*d* and score line 178*b* intersecting score line 102*a*.

Additional stress relief lines 182 and 184 are disposed on side panel 104 extending lengthwise from semicircular score line 166, as shown. Additional stress-relief lines 186 and 18 are disposed on side panel 106 extending lengthwise from semicircular score line 168, as shown in FIG. 1.

In aggregate, the stress relief lines described hereinabove serve to control bowing of top panel 102 when the carrier is lifted, distributing forces to other portions of the carrier, namely to side panels 104 and 106 and the corners of top panel 102.

The advantages of providing score lines in the top and side panels to distribute the forces from lifting a carrier having a single opening handle has generally been recognized, for example U.S. Pat. No. 4,785,991 ("Schuster"). In the Schuster patent, slits extending from the ends of the handle opening into the upper portions of the side panels allow the top panel and side panels to flex sufficiently to permit the carrier to be lifted by the handle opening. Score lines in the upper portions of the side panels provide relief from lifting forces. Additional score lines in the upper panel also provide stress relief.

Tear-stop Score Lines

Despite the stress relief measures described hereinabove, both for the carrier of the present invention as well as carriers of the prior art, there may nevertheless be a tendency for a tear to initiate when lifting a fully-loaded carrier. Such a tear will tend to initiate at an edge of the handle opening (140) and, left unchecked, may result in enlarging the opening sufficiently to allow contents of the carrier to fall out. Slits extending from the ends of the handle opening, as described in the Schuster patent, may actually contribute to such tearing of the top panel.

According to the present invention, tear-stop score lines are provided closely adjacent the handle opening for preventing tears originating at the handle opening from propagating across the top panel of the carrier.

A tear-stop score line arrangement 190 is formed as follows: a score line 192 extends laterally across the top panel 102, generally parallel to and approximately halfway between the score lines 142 and 162. Similarly, a score line 194 extends laterally across the top panel 102, generally parallel to and approximately halfway between the score lines 144 and 164. Score line 194 is preferably parallel to score line 192, and they are spaced a distance (width dimension) apart from one another which is approximately 12–18% of the length "L" of top panel 102. A semi-circular score line 196 is disposed on the top panel 102 and connects the ends of the two score lines 192 and 194. A semi-circular score line 198 is disposed on the top panel 102 and connects the opposite ends of the two score lines 192 and 194. From end-to-end (196-to-198), the tear-stop score line arrangement 190 has a length dimension which is approximately 85–95% of the distance, or width "W") across the top panel 102. Score lines 192, 194, 196 and 198 are preferably contiguous with one another. In aggregate, score lines 192, 194, 196 and 198 form a generally-rectangular tear-stop score line arrangement 190 which extends laterally across top panel 102, without extending down into side panels 104 and 106, and which is centered around handle opening 140, between handle opening 140 and stress-relief score line arrangement 160.

Tear-stop score line arrangement 190 is approximately 20–30% longer (from end-to-end, across the top panel 102) than handle opening 140, and is approximately 2–2.5 times wider (from side-to-side) than handle opening 140. By way of comparison, stress-relief score line arrangement 160 is approximately 3–4 times wider than handle opening 140.

Tear-stop score line arrangement 190 encircles handle opening 140, is larger than handle opening 140, is preferably concentric with handle opening 140, and is offset from handle opening 140.

Tear-stop score line arrangement 190 focuses pressure onto the score line arrangement 190 without tearing it. Score line arrangement 190 encircling handle opening 140 prevents excess pressure from tearing the side panels when lifting the carrier by its integral handle 140.

Although the present invention has been described in a given embodiment thereof, many variations and modifications will become apparent to those skilled in the art. It is therefore understood that the present invention be limited not by the specific disclosure herein, but only by the claims appended hereinafter.

What is claimed is:

1. A sleeve-type carrier comprising:

a top panel, opposing side panels, opposing end panels and a bottom panel;

a handle opening extending laterally across said top panel;

a continuous score line disposed on said top panel, generally encircling said handle opening and extending onto said side panels; and a pair of longitudinally separated, diverging, perforated score lines extending from the laterally opposite ends of said handle opening terminating at said score line.

2. The beverage carrier as claimed in claim 1 wherein said handle opening and said score line are oval shaped.

3. The beverage carrier as claimed in claim 2 wherein said encircling oval shaped score line comprises a pair of parallel score lines, one on either side of said oval handle opening, extending laterally between said top panel's side edges and having a semi-circular score line, extending onto each associated side panel, thereby closing off each end of said oval shaped score line.

4. The beverage carrier as claimed in claim 3 wherein an additional encircling score line is provided within said oval shaped score line encircling said handle opening.

5. The beverage carrier as claimed in claim 4 wherein said additional score line is oval shaped.

6. The beverage carrier as claimed in claim 5 wherein said additional, oval shaped score line extends onto said side panels.

7. The beverage carrier as claimed in claim 5 wherein:

said top panel has a longitudinal length (L) and a lateral width (W);

said handle opening extends approximately 70–75% of the width across said top panel; and said additional oval shaped score line score line extends approximately 85–95% of the width across said top panel.

8. A unitary paperboard blank for forming a sleeve-type beverage carrier comprising:

a top panel, a pair of opposing side panels each attached to said top panel by a longitudinally extending score line, and a pair of partial bottom panel flaps one each attached to an associated side panel by an associated score line;

a handle opening extending laterally across said top panel;

a continuous score line encircling said handle opening and extending onto side panels; and a pair of longitudinally separated, diverging perforated lines extending laterally from the laterally opposing ends of said handle opening and terminating at said encircling score line.

9. The blank as claimed in claim 8 wherein said handle opening and said encircling score line is oval shaped.

10. The blank as claimed in claim 9 wherein said oval shaped score line comprises a pair of parallel score lines astride said handle opening extending the fill lateral width of said top panel and closed at each end by an associated semi-circular score line, said semi circular score lines extending onto said side panels.

* * * * *

UNITED STATES PATENT AND TRADEMARK OFFICE

CERTIFICATE OF CORRECTION

PATENT NO. : 6,237,839 B1
DATED : May 29, 2001
INVENTOR(S) : Brown

It is certified that error appears in the above-identified patent and that said Letters Patent is hereby corrected as shown below:

Title page, column 2,
Line 3, replace "Strout" with -- Stout --.

Claims, column 7,
Line 5, replace "fill" with -- full --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*